US007938632B2

(12) United States Patent
Smith

(10) Patent No.: US 7,938,632 B2
(45) Date of Patent: May 10, 2011

(54) PISTON PUMP WITH CAM FOLLOWER ARRANGEMENT

(75) Inventor: Alan Smith, Staffordshire (GB)

(73) Assignee: ITW Limited, Berkshire (GB)

( * ) Notice: Subject to any disclaimer, the term of this patent is extended or adjusted under 35 U.S.C. 154(b) by 595 days.

(21) Appl. No.: 10/596,642

(22) PCT Filed: Dec. 14, 2004

(86) PCT No.: PCT/GB2004/005219

§ 371 (c)(1),
(2), (4) Date: Mar. 7, 2007

(87) PCT Pub. No.: WO2005/061889

PCT Pub. Date: Jul. 7, 2005

(65) Prior Publication Data

US 2007/0169619 A1 Jul. 26, 2007

(30) Foreign Application Priority Data

Dec. 20, 2003 (GB) ..... 0329585.4

(51) Int. Cl.
*F04B 17/03* (2006.01)
*F04B 23/06* (2006.01)
*F16H 53/00* (2006.01)

(52) U.S. Cl. ..... 417/415; 417/521; 74/567; 74/569; 92/129; 92/150

(58) Field of Classification Search ..... 417/415, 417/273, 397, 429, 470, 521, 535, 549; 92/129, 92/140, 150; 74/567, 569
See application file for complete search history.

(56) References Cited

U.S. PATENT DOCUMENTS

| | | | | | |
|---|---|---|---|---|---|
| 1,512,029 | A | * | 10/1924 | Buvinger et al. | 417/38 |
| 3,150,603 | A | * | 9/1964 | Yarger | 91/477 |
| 3,369,532 | A | * | 2/1968 | McIlroy | 123/90.16 |
| 3,413,929 | A | * | 12/1968 | Cook et al. | 417/273 |
| 3,471,079 | A | * | 10/1969 | Myers | 417/397 |
| 3,816,025 | A | | 6/1974 | O'Neill | |
| 3,816,029 | A | * | 6/1974 | Bowen et al. | 417/223 |

(Continued)

FOREIGN PATENT DOCUMENTS

CN 86209937 A 12/1987

(Continued)

OTHER PUBLICATIONS

Seizaburo Ashiba, Translation of Exhibit No. 5: Mechanical Kinetics, Mechanical Kinetics.

*Primary Examiner* — Devon C Kramer
*Assistant Examiner* — Nathan Zollinger
(74) *Attorney, Agent, or Firm* — Lowe Hauptman Ham & Berner LLP

(57) ABSTRACT

A pump primarily for liquid paint includes first and second pistons reciprocable rectilinearly in respective first and second cylinders. The first and second pistons are moved relative to their respective pistons by operation of an A. C. electric motor the rotary output shaft of which is coupled to the first and second pistons by a constant velocity cam and a cam follower mechanism converting rotary motion of the output shaft into reciprocatory motion of the first and second pistons 180° out of phase with one another.

22 Claims, 4 Drawing Sheets

U.S. PATENT DOCUMENTS

| | | | | | |
|---|---|---|---|---|---|
| 4,009,971 | A | * | 3/1977 | Krohn et al. | 417/43 |
| 4,516,725 | A | * | 5/1985 | Cavanaugh et al. | 239/127 |
| 4,597,717 | A | * | 7/1986 | Mohr | 417/265 |
| 4,917,296 | A | | 4/1990 | Konieczynski | |
| 5,094,596 | A | | 3/1992 | Erwin et al. | |
| 5,096,120 | A | | 3/1992 | Luckarz | |
| 5,145,339 | A | * | 9/1992 | Lehrke et al. | 417/521 |
| 5,195,680 | A | | 3/1993 | Holt | |
| 5,195,879 | A | * | 3/1993 | Reese et al. | 417/521 |
| 5,220,259 | A | | 6/1993 | Werner et al. | |
| 5,573,386 | A | * | 11/1996 | Schmitt et al. | 417/521 |
| 5,588,817 | A | * | 12/1996 | Zirps et al. | 417/549 |
| 6,280,162 | B1 | * | 8/2001 | Scheibel et al. | 417/546 |
| 6,672,686 | B2 | * | 1/2004 | Lubischer | 303/116.4 |
| 7,026,365 | B2 | | 4/2006 | Lee et al. | |
| 7,273,003 | B2 | * | 9/2007 | Yamashita et al. | 91/188 |
| 2003/0101931 | A1 | | 6/2003 | Estelle | |

FOREIGN PATENT DOCUMENTS

| | | | |
|---|---|---|---|
| EP | 0334994 | A1 | 10/1989 |
| EP | 0484762 | A1 | 5/1992 |
| FR | 2656348 | A3 | 6/1991 |
| GB | 336810 | A | 10/1930 |
| GB | 337205 | A | 10/1930 |
| GB | 411149 | A | 6/1934 |
| GB | 1155328 | A | 6/1969 |
| GB | 1481043 | A | 7/1977 |
| GB | 2130305 | A | 5/1984 |
| JP | 2001241380 | A | 9/2001 |
| JP | 2001271755 | A | 10/2001 |
| JP | 2002013479 | A | 1/2002 |
| JP | 2003042069 | A | 2/2003 |
| WO | 03012296 | A1 | 2/2003 |

* cited by examiner

PISTON PUMP WITH CAM FOLLOWER ARRANGEMENT

RELATED APPLICATIONS

The present application is a National Phase application based on International Application Number PCT/GB2004/005219, filed Dec. 14, 2004, which claims priority from, British Application Number 0329585.4, filed Dec. 20, 2003, the disclosure of which is hereby incorporated by reference herein in its entirety.

TECHNICAL FIELD

This invention relates to a pump, primarily but not exclusively for supplying liquid paint to a pressure loop serving one or more spray guns.

BACKGROUND ART

U.S. Pat. No. 5,094,596 discloses a pump having a pair of opposed and interconnected pistons reciprocable in respective cylinders to pump paint. The interconnected pistons are driven in their reciprocatory motion by an air motor and while one piston and cylinder arrangement is pumping paint to supply paint under pressure into a pressure loop, the other piston and cylinder arrangement is being re-charged by drawing paint from a reservoir into the cylinder for subsequent discharge therefrom into the pressure loop in a subsequent reverse movement of the pistons during which the first mentioned piston will draw paint into its respective cylinder to re-charge that cylinder.

Air motors require an external source of compressed air in order to operate, and it is recognised that such systems are relatively inefficient in terms of energy utilisation. Moreover the change in drive direction at each end of reciprocatory stroke of an air motor is relatively slow giving rise to noticeable pulsation in the output of the pump. U.S. Pat. No. 5,220,259 discloses a single reciprocating piston pump of relatively large stroke driven by a D.C. electric motor, an arrangement which is disadvantageous in requiring a complex, and therefore expensive control arrangement for the motor.

It is an object of the present invention to provide a twin opposed piston reciprocating pump which is driven electrically in a simple and convenient manner.

DISCLOSURE OF INVENTION

In accordance with the present invention there is provided a pump comprising first and second pistons reciprocable rectilinearly in respective first and second cylinders, said first and second pistons being moved relative to their respective pistons by operation of an alternating current (A.C.) electric motor the rotary output shaft of which is coupled to said first and second pistons by means including a constant velocity cam and cam follower mechanism converting rotary motion of the output shaft into reciprocatory motion of said first and second pistons 180° out of phase with one another.

Preferably said first and second pistons are axially aligned.

Desirably said first and second axially aligned pistons cooperate with said constant velocity cam through the intermediary of respective cam followers engaging said constant velocity cam at opposite ends of a diameter of the circle of rotation of said cam.

Preferably said cam followers are roller cam followers.

Preferably said first and second cam followers are spring urged into engagement with the cam surface of said constant velocity cam.

Desirably said first and second cam followers are simultaneously urged to engage the cam surface of said constant velocity cam by compression springs.

Alternatively said first and second cam followers are interconnected by tension spring means simultaneously urging both cam followers to engage the cam surface of said constant velocity cam.

Preferably the pump includes third and fourth axially aligned pistons reciprocable in respective third and fourth cylinders, said third and fourth pistons being driven for reciprocatory movement 180° out of phase with one another by a second constant velocity cam driven by said A.C. motor output shaft, the reciprocable movement of said third and fourth pistons being 90° out of phase with the reciprocatory movement of said first and second pistons.

Preferably paint discharged from said first, second, third and fourth cylinders is supplied to a common pressure loop.

Conveniently a gearbox is interposed between the output shaft of the motor and said constant velocity cam or cams.

Preferably said gearbox is a reduction gearbox.

If desired a flywheel can be associated with the drive transmission between the A.C. motor output shaft and the or each constant velocity cam.

BRIEF DESCRIPTION OF THE DRAWINGS

One example of the invention as illustrated in the accompanying drawings wherein.

PREFERRED MODES OF CARRYING OUT THE INVENTION

Figure 1:
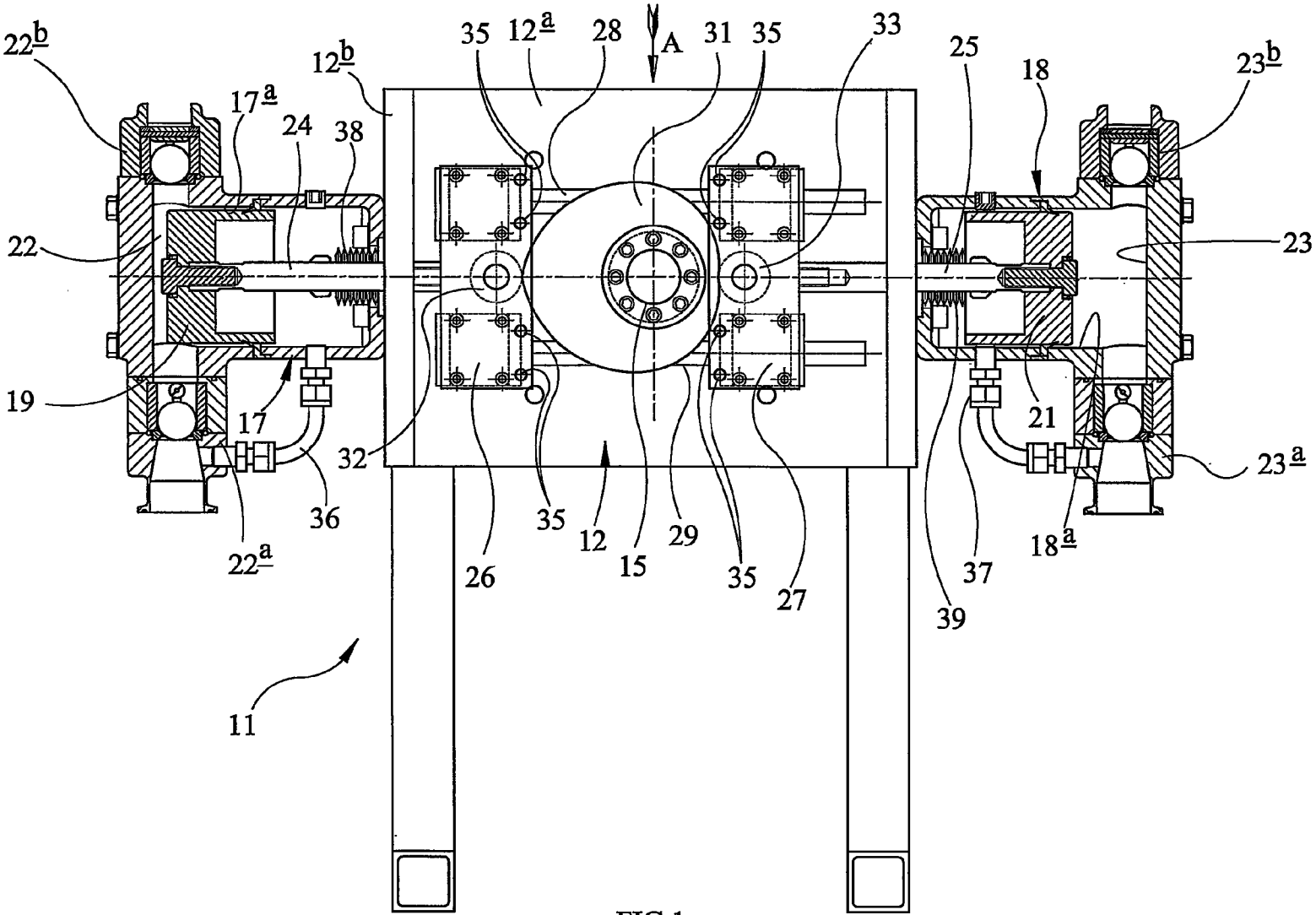
FIG. 1 is a front elevational view of a twin opposed piston electrically driven pump.

Referring to the drawings the pump which is primarily, but not exclusively, intended for supplying liquid paint to a pressure loop or paint circuit in turn supplying one or more spray guns, comprises a rigid supporting frame 11 including a mounting block 12 having a base plate 12*a* and upstanding, parallel, spaced side plates 12*b*, 12*c* extending at right angles to the base plate 12*a*. Although omitted from FIG. 1 for clarity, it can be seen from FIG. 2 that a front plate 12*d* extends parallel to the base plate 12*a* and is spaced therefrom by the side plates 12*b*, 12*c*. The plates 12*a*, 12*b*, 12*c*, 12*d* are secured together in any convenient manner, for example by means of bolts, to define a rigid box-like structure.

Bolted to the rear face of the plate 12*a* and extending at right angles thereto is a reduction gearbox 14 carrying, at its end remote from the plate 12*a*, an A.C. electric induction motor 13. The rotational axis of the rotor of the motor 13 is coincident with the longitudinal axis of the gearbox 14 and the output shaft of the motor 13 drives the input element of the gearbox 14, the output shaft of the gearbox 14 extending through bearings at the end of the gearbox 14 and protruding through a centrally disposed aperture in the plate 11*a*. The output shaft 15 of the gearbox 14 protrudes across the gap between the plates 12*a*, 12*d* and is received, at its free end, in a bearing 16 in the plate 12*d*. Bolted to the exterior face of the side plate 12*b* is a first cylinder assembly 17, and a second, identical cylinder assembly 18 is bolted to the exterior of the side plate 12*c*, the assemblies 17, 18 being axially aligned. Each cylinder assembly includes a cylinder 17*a*, 18*a* slidably receiving a respective piston 19, 21. At its outermost end each cylinder assembly 17, 18 defines, with its respective piston 19, 21, a pumping chamber 22, 23 having a respective inlet union 22*a*, 23*a* and a respective discharge union 22*b*, 23*b*. Each inlet union 22*a*, 23*a* includes a non-return valve ensuring that liquid paint can be drawn from a supply line into the respective pumping chamber, but preventing discharge of paint from the chamber through the inlet union 22*a*, 23*a* during a pumping stroke of the respective piston. Similarly each output union 22*b*, 23*b* includes a respective non-return valve allowing liquid paint to flow from the respective pumping chamber 22, 23 by way of the outlet union but preventing liquid paint being drawn back into the pumping chamber 22, 23 through the respective union 22*b*, 23*b* during reverse movement of the respective piston.

Each piston 19, 21 is carried by a respective piston rod 24, 25 which extends through a respective sliding bearing in the base wall of the respective cylinder assembly 17, 18, and through a corresponding aperture in the respective side plate 12*b*, 12*c* for connection to a respective cam follower slider 26, 27 carried on the inner face of the plate 12*a*.

The inner face of the plate 12*a* has affixed thereto first and second guide rails or guide rods 28, 29 extending parallel to one another equidistantly spaced on opposite sides of the aperture through which the output shaft 15 of the gearbox 14 extends. The guide rails 28, 29 extend parallel to the axially aligned piston rods 24, 25 and the sliders 26, 27 are slidably mounted on the guide rails 28, 29 for guided, reciprocatory motion relative to the plate 12*a* in the direction of the common axis of the piston rods 24, 25.

A "heart-shaped" constant velocity cam 31 is secured to the shaft 15 between the plates 12*a* and 12*d* for rotation with the shaft. Each slider 26, 27 carries a respective cam follower roller 32, 33 mounted on its respective slider for rotation about an axis parallel to the axis of rotation of the shaft 15. The rotational axis of the rollers 32, 33 intersect a diameter of the circle of rotation of the cam 31 and the sliders 26, 27 are resiliently urged towards one another such that the rollers 32, 33 engage the peripheral cam surface of the cam 31 diametrically opposite one another in relation to the circle of rotation of the cam. As the cam rotates the rollers roll on the cam surface of the cam and so follow the throw of the cam.

Figure 2:
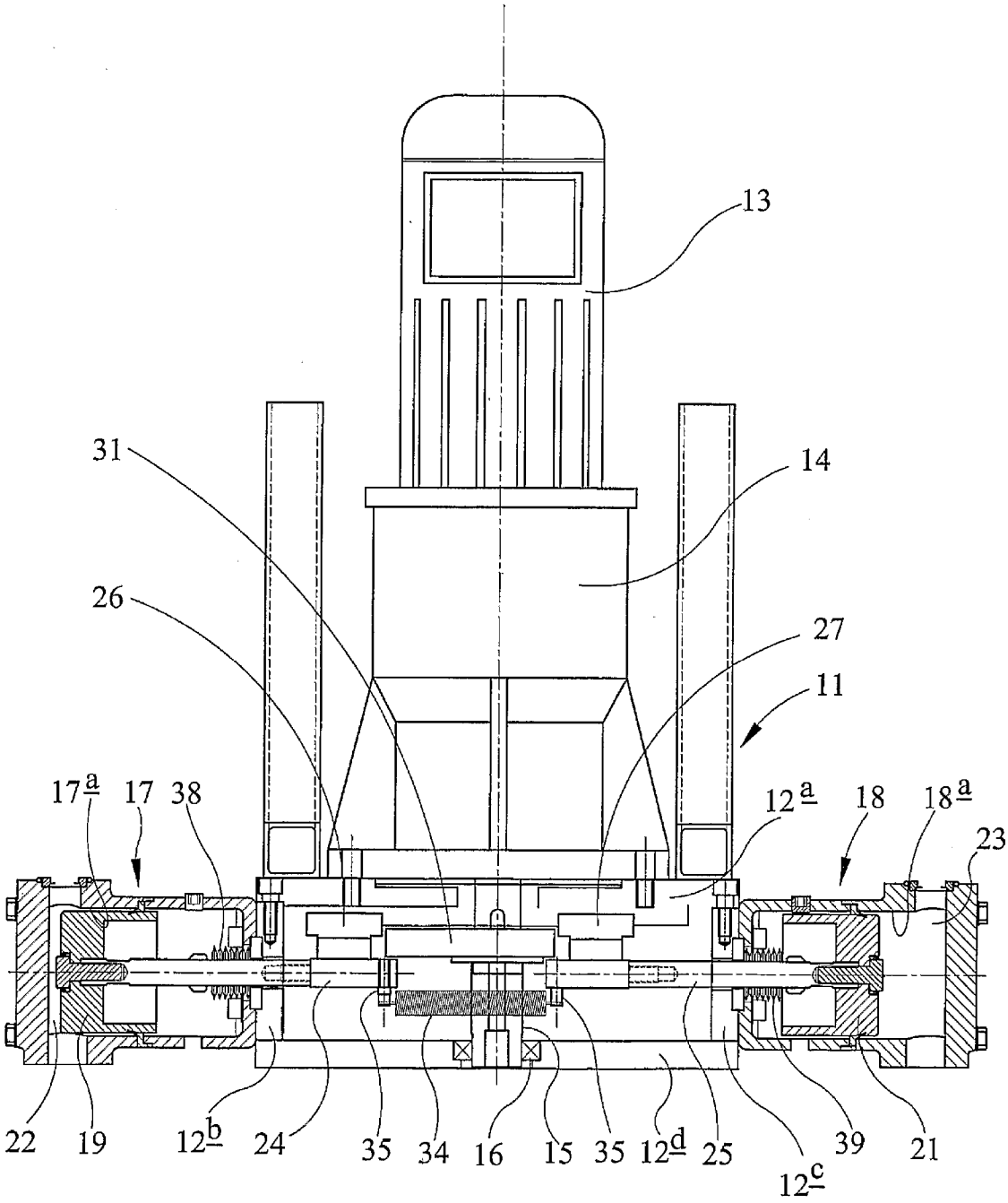
FIG. 2 is a view in the direction of arrow A in FIG. 1.
Figure 3:
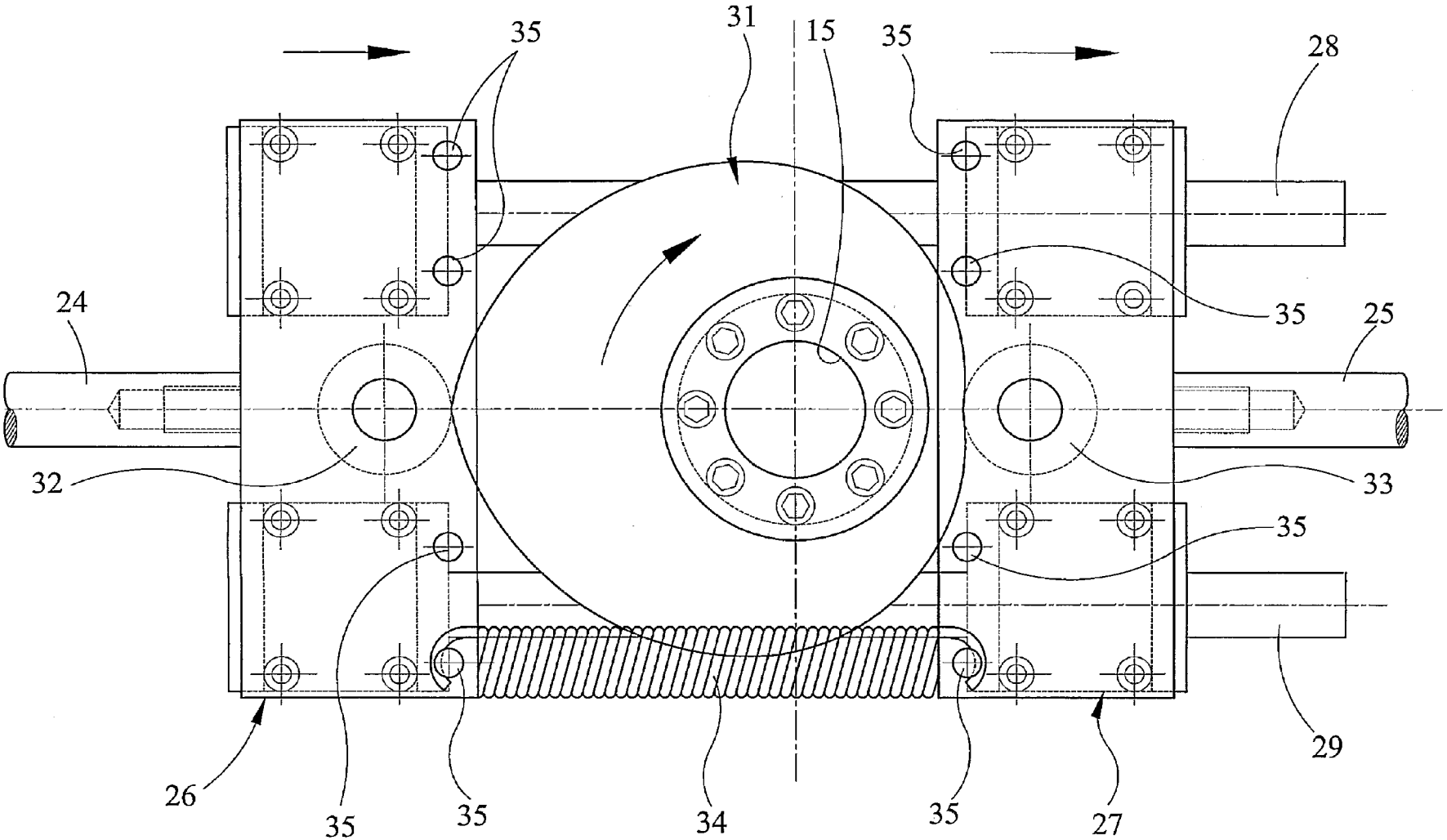
FIG. 3 is an enlarged front elevational view of part of the pump of FIG. 1 illustrating one of a pair of springs omitted from FIG. 1 for clarity.

The sliders 26, 27 are urged towards one another on opposite sides of the cam 31 by means of a pair of tension springs 34 (only one of which is shown in FIGS. 2 and 3). The springs 34 are helically coiled tension springs having hooked ends which engage around respective posts 35 protruding from the sliders 26, 27 respectively. Each slider 26, 27 has four posts 35 so that the sliders can be interconnected by two or four springs as desired. It will be recognised that the springs will, desirably, be equal in force on opposite sides of the plane containing the axes of rotation of the rollers 32, 33 and the shaft 15. The heart-shaped constant velocity cam 31 is symmetrical about a plane passing through its apex and its centre of rotation, and thus the movement of the sliders 26, 27, as the cam 31 rotates, will be 180° out of phase with one another, and with the exception of the instants at which the direction of reciprocatory movement of the sliders 26 and 27 changes, the speed of their rectilinear movement resulting from rotation of the cam 31 is constant.

A sliding seal is provided in known manner between the wall of each cylinder 17*a*, 18*a* and the respective piston 19, 21. However, some leakage past the seal can occur, and so each of the cylinder assemblies 17, 18 is provided with a drain arrangement 36, 37 whereby liquid paint seeping past the piston and cylinder seal can be drained from the respective cylinder assembly. Desirably, as shown in FIG. 1, liquid paint seeping past the piston and cylinder seals is returned by the drain arrangements 36, 37 to the inlet unions 22*a*, 23*a* of the chambers 22, 23 respectively. Moreover, a bellows seal 38, 39 engages each piston rod 24, 25 and the inner wall of its respective cylinder assembly 17, 18 to seal the sliding interface of the piston rod and the respective cylinder assembly.

The motor 13 is operated to produce a predetermined rotational output speed at its output shaft, the control of the A. C. induction motor 13 being a conventional inverter control system forming no part of the present invention. As the cam 31 rotates from the position shown in FIGS. 1 and 3 the roller 33 is driven to the right by the cam 31 sliding the slider 27 to the right on the guide rails 28, 29. The slider 27 is connected to the piston rod 25 and so the piston 21 is displaced to the right reducing the volume of the pumping chamber 23 which, at this stage, is full of liquid paint. The non-return valve in the inlet union 23 closes and paint is discharged from the chamber 23 into the pressure loop of the spraying system, through the outlet union 23*b* by the positive displacement of the slider 27 by the cam 31. Simultaneously the slider 26 carrying the piston rod 24 and the piston 19 is drawn to the right, along the guide rails 28 and 29 by the action of the springs 34 resiliently interconnecting the sliders 26, 27. Thus the roller 32 remains in contact with the cam surface of the constant velocity cam 31. Movement of the piston 19 to the right increases the volume of the pumping chamber 22 drawing liquid paint from the supply through the inlet union 22*a*. At this stage the non-return valve of the union 22*a* opens and the non-return valve of the outlet union 22*b* closes to prevent liquid paint flowing back into the chamber 22 from the pressure loop. Pumping of liquid paint into the pressure loop continues through 180° of rotation of the cam 31 at a constant velocity, and when the high point of the cam 31 passes the roller 33 the roller 32 coacts with the low point of the cam, and thereafter during continued rotation of the cam the slider 26 is driven to the left so that the piston 19 performs a pumping stroke in relation to the chamber 22, discharging liquid paint into the pressure loop by way of the union 22*b* while simultaneously the slider 27 follows the slider 26 to the left, by virtue of the spring connection between the two, so that the piston 21 performs an inlet stroke drawing liquid paint through the union 23*a* into the pumping chamber 23. It will be appreciated that the reciprocating motion of the pistons 19, 21 continues while the motor 13 drives the cam 31.

It will be understood that if desired, rather than the return motion of the pistons 19, 21 drawing liquid paint into the chambers 22, 23, the paint supply connected to the inlet unions 22*a*, 23*a* could be under low pressure so that the flow of paint into the pumping chambers 22, 23 at the appropriate time is assisted by the pressurisation of the paint supply.

As the cam 31 is a constant velocity cam, then the supply of paint under pressure into the pressure loop of the spraying system will be constant except for the points in the cycle at which the pistons 19, 21 undergo a change of direction, which by virtue of the cam and cam follower arrangement takes place very rapidly. While the piston 21 is pumping the piston 19 is allowing the chamber 22 to refill, and vice-versa.

Figure 4:
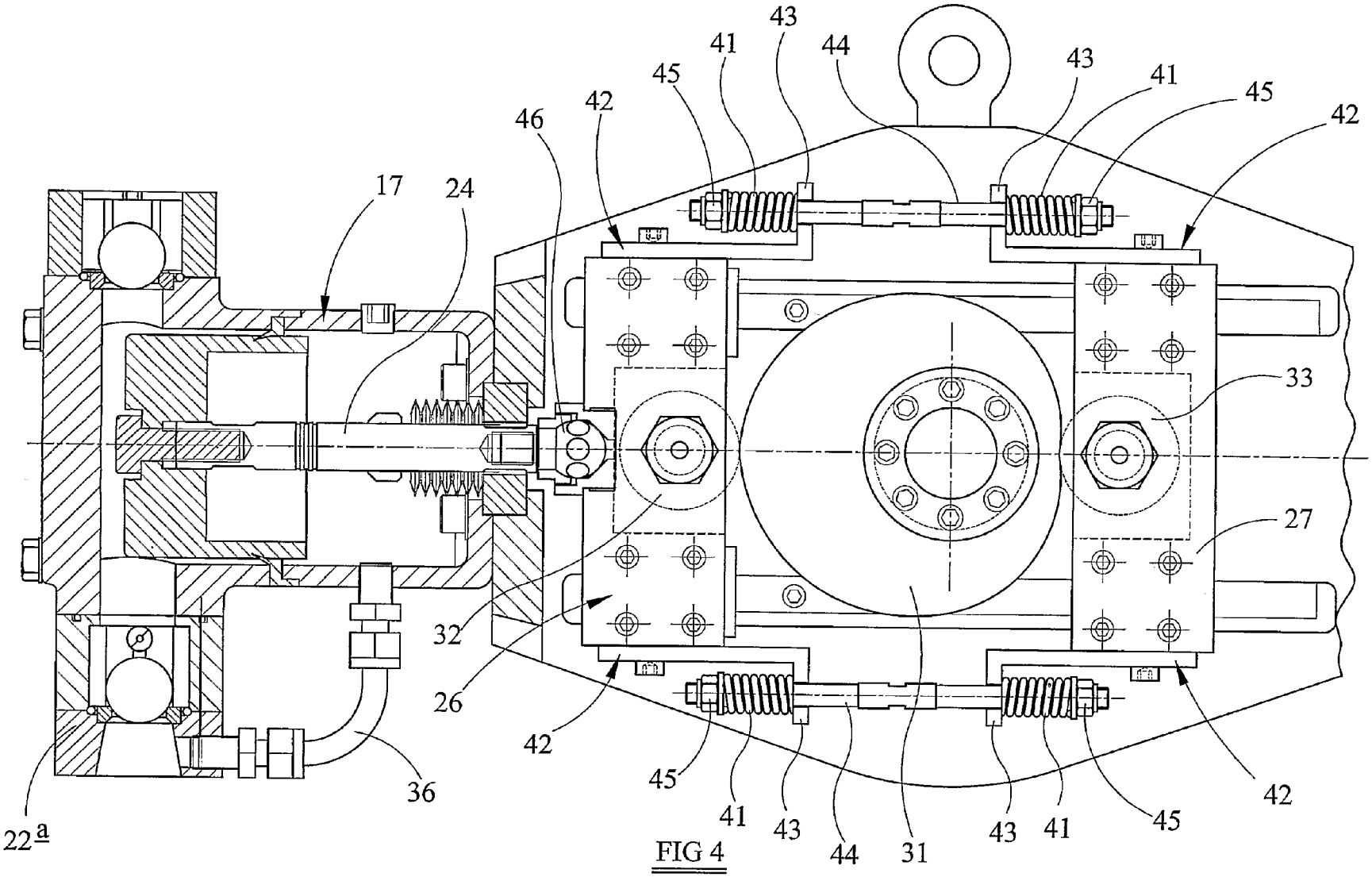
FIG. 4 is a view similar to FIG. 1 of a modification.

In the modification illustrated in FIG. 4 the tension springs 34 are replaced by four compression springs 41 each of which acts at one end against an outwardly projecting limb 43 of an L-shape bracket 42 the other limbs of which are bolted to the sliders 26, 27 respectively.

The brackets 42 can be considered to be in two pairs, one pair on each side of the longitudinal centre line of the pump.

The limbs 43 of each bracket 42 are formed with a through bore, and associated with each pair of brackets is an elongate retaining rod 44 which extends slidably through the bores of the limbs 43 of its respective pair of brackets. The regions of each rod 44 projecting through the limbs 43 are encircled by respective springs 41 and nuts 45 in screw threaded engagement with the opposite of each rod 44 engage the outer ends of the springs 41 respectively and apply a predetermined axial pre-load to each spring 41 against its respective bracket limb 43.

In practice the rods are of a predetermined length, and the nuts 45 are threaded along the rods 44 by a predetermined amount selected in relation to the length and rating of the springs 41, such that the springs 41 apply a predetermined pre-load to their respective bracket limbs 43.

It will be recognised that the springs 41 urge the sliders 26, 27 towards one another so that the cam follower rollers 32, 33 bear on the cam surface of the cam 31. Thus the springs 41 act in mechanically the same manner as the springs 34 of the embodiment described above, but the springs 41 act in compression, rather than in tension. The brackets 42 and rods 44 are so positioned that a common plane containing their longitudinal axes is coincident with the median plane of the cam 31 and the cam follower rollers 32, 33, and contains the longitudinal axes of the piston rods 24, 25 of the pumping arrangements.

It will be recognised that in FIG. 4 the cylinder assembly 18 at the right hand side of the pump, together with its ancillary components, has been omitted for clarity. Thus the piston rod 25 which is linked to the slider 27 is not visible in FIG. 4.

It can be seen in FIG. 4 that the piston rod 24 is coupled to the slider 26 through the intermediary of a captive ball joint 46. The ball joint 46 accommodates small degrees of misalignment of the piston rod 24 relative to the longitudinal centre line of the slider arrangement as can occur, for example, as a result of tolerance build-up in the individual components which are assembled together. The captive ball joint 46 however transmits longitudinal movement of the slider 26 to the rod 24 in both directions of movement of the slider. A similar captive ball joint links the slider 27 to the piston rod 25, and it is to be understood that similar ball joints can be incorporated into the assembly described above with FIGS. 1, 2 and 3.

The use of springs loading the cam follower rollers against the cam 31 is advantageous in that it provides a predetermined preload of the rollers against the cam and within recognised limits manufacturing tolerances and wear of cam and rollers is automatically accommodated by the springs. A controlled preload avoids the risk of premature failure through excessive roller/cam loading and the springs avoid the need for complex adjustment mechanisms to accommodate wear and tolerances. It will be understood that using the springs to link the sliders and preload the engagement with the cam avoids the possibility of a gap between one or both rollers and the cam which would, if present, result in delays in piston direction change at the stroke ends with consequential fluctuations in pump output.

Should it be desired to increase the capacity of the system, and/or minimise pulsation of the pressure in the pressure loop during changes in the reciprocatory direction of the pistons 19, 21 then the shaft 15 can simultaneously drive a second cam identical to the cam 31, but 90° out of phase therewith. The second constant velocity cam will cooperate with respective sliders identical to the sliders 26, 27 but axially spaced therefrom in the direction of the axis of the shaft 15. The two additional sliders will be coupled to respective third and fourth piston and cylinder arrangements identical to those associated with the sliders 26 and 27. In such an arrangement the third and fourth piston and cylinder arrangements will be at the mid-point of their reciprocatory motion when the piston and cylinder arrangements 17, 19 and 18, 21 are at the ends of their reciprocatory movement. Thus at any given point in the rotation of the shaft 15 at least one piston and cylinder arrangement will be performing a pumping stroke displacing pressurised liquid paint into the associated spray gun pressure loop. The additional cylinder assemblies can be carried on extensions of the side plates 12*b*, 12*c* and the sliders can be carried on the plate 12*d* or on an additional plate parallel to plates 12*a*, 12*d*.

It will be recognised that if desired a surge eliminator of known form can be associated with the pressure loop to further smooth the pressure fluctuations in the pressure loop.

Although the motor 13 drives the or each constant velocity cam through a gearbox 14 it will be recognised that if desired a flywheel can be incorporated, preferably between the motor 13 and the gearbox 14 to minimise the effect of loading changes in the system as reversal of the direction of reciprocatory movement of the pistons occurs.

A pressure operated switch is incorporated in the output loop or in each outlet union of each pumping chamber to de-energise the motor 13 and cease pumping if the output pressure exceeds a predetermined safe valve, for example as a result of a filter or line blockage or failure of an output union non-return valve.

In one practical embodiment of the pump of FIG. 1 each piston is arranged to have a relatively short stroke of 30 to 80 mm, conveniently 40 mm, thus facilitating the use of an AC motor driving the pistons through a constant velocity cam 31. Moreover, the selection of a short stroke twin piston arrangement facilitates the use of relatively large piston diameters, between 60 and 150 mm and conveniently 100 mm, the motor 13 being operated so that the pump delivers between 10 and 55 liters/minute (up to 110 liters/minute for a four cylinder pump).

The invention claimed is:

1. A pump, comprising:

a constant velocity cam driven by a rotary shaft;

first and second cylinders;

first and second pistons reciprocable rectilinearly in the respective first and second cylinders;

first and second cam followers which, together with the constant velocity cam, couple the rotary output shaft to said first and second pistons, respectively, for converting rotary motion of the constant velocity cam into reciprocatory motion of said first and second pistons 180° out of phase with one another;

at least one guide rail extending parallel to an axis along which the pistons are rectilinearly reciprocable;

first and second cam follower sliders each of which is slidably mounted on said at least one guide rail and each of which carries thereon the respective first or second cam follower; and at least one spring acting on at least one of the first and second cam follower sliders and simultaneously urging both said cam followers toward each other to engage the cam surface of said constant velocity cam;

wherein an entirety of the at least one spring is moveable relative to the first and second cylinders.

2. A pump as claimed in claim 1, wherein said at least one spring comprises a compression spring.

3. A pump as claimed in claim 1, wherein said at least one spring comprises a tension spring.

4. A pump as claimed in claim 3, wherein said tension spring directly connects the first and second cam follower sliders for simultaneously urging both said cam followers toward each other to engage the cam surface of said constant velocity cam.

5. A pump as claimed in claim 2, further comprising:

a retaining rod extending between the first and second cam follower sliders, and having opposite first and second ends associated with the first and second cam follower sliders, respectively;

wherein said compression spring is mounted between the first end of the retaining rod and the first cam follower slider, and urges the first end of the retaining rod away from the second cam follower slider for simultaneously urging both said cam followers toward each other to engage the cam surface of said constant velocity cam.

6. A pump as claimed in claim 1, further comprising:

first and second brackets attached to the first and second cam follower sliders, respectively, and having first and second through bores, respectively; and a retaining rod extending slidably through the first and second bores and having first and second ends projecting beyond said first and second bores, respectively;

wherein said at least one spring comprises first and second compression springs mounted between (i) the first and second ends of the retaining rod, respectively, and (ii) the first and second brackets, respectively, for simultaneously urging both said cam followers toward each other to engage the cam surface of said constant velocity cam.

7. A pump as claimed in claim 1, wherein said first and second pistons are axially aligned.

8. A pump as claimed in claim 7, said cam followers engaging said constant velocity cam at opposite ends of a diameter of the circle of rotation of said cam.

9. A pump as claimed in claim 1, wherein said cam followers are roller cam followers.

10. A pump as claimed in claim 1, further comprising:

third and fourth cylinders;

a second constant velocity cam driven by said rotary output shaft; and third and fourth axially aligned pistons reciprocable in the respective third and fourth cylinders, said third and fourth pistons being driven for reciprocatory movement 180° out of phase with one another by said second constant velocity cam, the reciprocable movement of said third and fourth pistons being 90° out of phase with the reciprocatory movement of said first and second pistons.

11. A pump as claimed in claim 10, further comprising:

a common pressure loop to which liquid discharged from said first, second, third and fourth cylinders is to be supplied.

12. A pump as claimed in claim 1, further comprising:

a reduction gearbox interposed between the output shaft and said constant velocity cam.

13. A pump as claimed in claim 1, further comprising:

a flywheel incorporated in the drive transmission between the output shaft and the constant velocity cam.

14. A pump as claimed in claim 1, further comprising:

first and second captive ball joints coupling the respective first and second cam followers to the respective first and second pistons.

15. A pump, comprising:

an A.C. electric motor having a rotary output shaft;

first and second cylinders;

first and second pistons reciprocable rectilinearly in the respective first and second cylinders;

a constant velocity cam driven by the rotary output shaft; and first and second cam followers which, together with the constant velocity cam, couple the rotary output shaft to said first and second pistons, respectively, for converting rotary motion of the output shaft into reciprocatory motion of said first and second pistons 180° out of phase with one another, wherein said first and second cam followers are interconnected by a spring arrangement simultaneously urging both said cam followers toward each other to engage the cam surface of said constant velocity cam, and wherein an entirety of the spring arrangement is moveable following rotary motion of said constant velocity cam;

two guide rails extending parallel to and on opposite sides of an axis along which the pistons are rectilinearly reciprocable;

first and second cam follower sliders each of which is slidably mounted on both said guide rails and each of which carries thereon a roller defining the respective first or second cam follower;

first and second brackets attached to the first and second cam follower sliders, respectively, and having first and second through bores, respectively;

a retaining rod extending slidably through the first and second bores and having first and second ends projecting beyond said first and second bores, respectively; and first and second compression springs mounted between (i) the first and second ends of the retaining rod, respectively, and (ii) the first and second brackets, respectively, for simultaneously urging both said cam followers toward each other to engage the cam surface of said constant velocity cam.

16. A pump as claimed in claim 15, wherein each said piston is arranged to have a stroke of 30 to 80 mm.

17. A pump as claimed in claim 16, wherein each said piston has a diameter of between 60 and 150 mm.

18. A pump as claimed in claim 17, being a liquid paint circulating pump.

19. A pump, comprising:

an A.C. electric motor having a rotary output shaft;

first and second cylinders;

first and second pistons reciprocable rectilinearly in the respective first and second cylinders;

a constant velocity cam driven by the rotary output shaft; and first and second cam followers which, together with the constant velocity cam, couple the rotary output shaft to said first and second pistons, respectively, for converting rotary motion of the output shaft into reciprocatory motion of said first and second pistons 180° out of phase with one another, wherein said first and second cam followers are interconnected by a spring arrangement simultaneously urging both said cam followers toward each other to engage the cam surface of said constant velocity cam, and wherein an entirety of the spring arrangement is moveable following rotary motion of said constant velocity cam;

two guide rails extending parallel to and on opposite sides of an axis along which the pistons are rectilinearly reciprocable;

first and second cam follower sliders each of which is slidably mounted on both said guide rails and each of which carries thereon a roller defining the respective first or second cam follower; and at least one tension spring directly connecting the first and second cam follower sliders for simultaneously urging both said cam followers toward each other to engage the cam surface of said constant velocity cam.

20. A pump as claimed in claim 19, wherein each said piston is arranged to have a stroke of 30 to 80 mm.

21. A pump as claimed in claim 20, wherein each said piston has a diameter of between 60 and 150 mm.

22. A pump as claimed in claim 21, being a liquid paint circulating pump.

* * * * *